US005410885A

United States Patent [19]

Smolarek et al.

[11] Patent Number: 5,410,885

[45] Date of Patent: May 2, 1995

[54] CRYOGENIC RECTIFICATION SYSTEM FOR LOWER PRESSURE OPERATION

[76] Inventors: James Smolarek, 6730 Liebler Rd., Boston, N.Y. 14025; Kevin J. Potempa, 740 Robin Rd., Amherst, N.Y. 14228

[21] Appl. No.: 103,616

[22] Filed: Aug. 6, 1993

[51] Int. Cl.[6] ..... F25J 3/02

[52] U.S. Cl. ..... 62/25; 62/38

[58] Field of Search ..... 62/24, 25, 38, 41

[56] References Cited

U.S. PATENT DOCUMENTS

| | | | |
|---|---|---|---|
| Re. 33,026 | 8/1989 | Petit et al. | 62/36 |
| 3,034,306 | 5/1962 | Schuftan et al. | 62/13 |
| 3,236,059 | 2/1966 | Bernstein | 62/13 |
| 3,559,722 | 2/1971 | Schauls et al. | 165/1 |
| 4,133,662 | 1/1979 | Wagner | 62/13 |
| 4,372,764 | 2/1983 | Theobald | 62/13 |
| 4,560,398 | 12/1985 | Beddome et al. | 62/29 |
| 4,704,147 | 11/1987 | Kleinberg | 62/24 |
| 4,732,597 | 3/1988 | Jujasz et al. | 62/24 |
| 5,014,773 | 5/1991 | Beduz et al. | 165/115 |
| 5,122,174 | 6/1992 | Sunder et al. | 62/24 |
| 5,144,809 | 8/1992 | Chevalier et al. | 62/36 |

*Primary Examiner*—Ronald C. Capossela

[57] ABSTRACT

A double column cryogenic rectification system wherein lower pressure column bottoms undergo additional rectification within a once-through downflow reflux condenser by countercurrent direct contact flow with vapor generated by condensing higher pressure column shelf vapor enabling the higher pressure column to operate at a reduced pressure thus reducing feed compression power requirements.

13 Claims, 3 Drawing Sheets

CRYOGENIC RECTIFICATION SYSTEM FOR LOWER PRESSURE OPERATION

TECHNICAL FIELD

This invention relates to cryogenic rectification, such as the cryogenic rectification of air employing a double column.

BACKGROUND ART

Cryogenic rectification, such as the cryogenic rectification of air employing a double column is a well established commercial process. In the double column process, feed undergoes a preliminary separation in a higher pressure column with a further separation in a lower pressure column to produce product. A major cost for the system is the power cost to compress the feed to the pressure necessary for operation of the higher pressure column.

The higher pressure column and the lower pressure column are thermally linked wherein higher pressure column top vapor or shelf vapor is used to reboil lower pressure column bottom liquid in a main condenser/-reboiler. A temperature difference must be maintained across this main condenser/reboiler. The temperature at which the shelf vapor must be condensed determines the pressure at which the feed must be supplied to the higher pressure column.

In the conventional double column system, there is employed a pool boiling thermo-syphon main condenser/reboiler which is packed with tubes that are open at both ends and are surrounded by a shell. Typically, the condenser/reboiler is positioned at the bottom of the lower pressure column and is partially submerged in a pool of bottom liquid. The liquid level outside the condenser/reboiler creates a pressure and density gradient within the tubes which forces the bottom liquid to flow up the tubes. While in the tubes, the liquid is partially vaporized by shelf vapor condensing on the shell side of the condenser/reboiler. Within the tubes, the resulting vapor and remaining liquid flow cocurrently upwards and a mixture of vapor and liquid emerges from the top of the condenser/reboiler. The vapor continues up the lower pressure column as reboil and the liquid returns to the pool. The liquid head at the bottom of the main condenser/reboiler requires that the operating pressure necessary in the higher pressure column be greater than would otherwise be the case. This greater pressure increases the feed compression requirements and consequently the operating costs of the rectification system.

Accordingly, it is an object of this invention to provide a cryogenic rectification system which can operate at a lower pressure than comparable conventional cryogenic rectification systems thus enabling a reduction in the feed compression requirements and consequently the operating costs of the cryogenic rectification system.

SUMMARY OF THE INVENTION

The above and other objects which will become apparent to one skilled in the art upon a reading of this disclosure are attained by the present invention, one aspect of which is:

A process for the cryogenic rectification of feed air comprising:

(A) providing feed air into the higher pressure column of a double column and separating the feed air by cryogenic rectification within the higher pressure column into nitrogen-enriched vapor and oxygen-enriched liquid;

(B) passing oxygen-enriched liquid into the lower pressure column of the double column and producing by cryogenic rectification oxygen-rich liquid within the lower pressure column;

(C) passing oxygen-rich liquid into the upper portion of a downflow reflux condenser and vaporizing a portion of the liquid flowing down the downflow reflux condenser by indirect heat exchange with nitrogen-enriched vapor to produce oxygen-rich vapor;

(D) passing said oxygen-rich vapor in countercurrent direct contact flow with downflowing oxygen-rich liquid within the downflow reflux condenser to produce oxygen-richer liquid; and (E) withdrawing oxygen-richer liquid from the lower portion of the downflow reflux condenser having an oxygen concentration which exceeds that of the oxygen-rich liquid passed into the upper portion of the downflow reflux condenser.

Another aspect of the invention is:

A cryogenic rectification apparatus comprising:

(A) a double column comprising a first column and a second column;

(B) means for passing feed into the first column and means for passing fluid from the first column into the second column;

(C) a downflow reflux condenser and means for passing fluid from the first column into the downflow reflux condenser;

(D) means for passing liquid into the upper portion of the downflow reflux condenser and means for passing liquid and vapor in countercurrent direct contact flow within the downflow reflux condenser; and (E) means for withdrawing liquid from the lower portion of the downflow reflux condenser.

A further aspect of this invention comprises:

A process for the cryogenic rectification of feed air comprising:

(A) passing feed air into a single column and separating the feed air by cryogenic rectification within the single column into nitrogen-rich vapor and oxygen-enriched liquid;

(B) passing oxygen-enriched liquid into the upper portion of a downflow reflux condenser and vaporizing a portion of the liquid flowing down the downflow reflux condenser by indirect heat exchange with nitrogen-rich vapor to produce oxygen-enriched vapor;

(C) passing said oxygen-enriched vapor in countercurrent direct contact flow with downflowing oxygen-enriched liquid within the downflow reflux condenser to produce oxygen-richer liquid; and (D) withdrawing oxygen-richer liquid from the lower portion of the downflow reflux condenser having an oxygen concentration which exceeds that of the oxygen-enriched liquid passed into the upper portion of the downflow reflux condenser.

Yet another aspect of the invention comprises:

A cryogenic rectification apparatus comprising:

(A) a single column and means for passing feed into the column;

(B) a downflow reflux condenser and means for passing fluid from the column into the downflow reflux condenser;

(C) means for passing liquid into the upper portion of the downflow reflux condenser and means for passing liquid and vapor in countercurrent direct flow contact within the downflow reflux condenser; and (D) means for withdrawing liquid from the lower portion of the downflow reflux condenser.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et al., page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 120° K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the terms "upper portion" and "lower portion" mean those sections of a condenser or column respectively above and below the midpoint of the condenser or column.

As used herein, the term "downflow reflux condenser" means a condenser/reboiler in which the liquid being boiled off is flowing downward through passages in counter-current contact with the resultant vapor.

DETAILED DESCRIPTION

The invention comprises an arrangement whereby the liquid head normally associated with the main condenser/reboiler of a double column system is eliminated. In the practice of this invention, bottom liquid flows downward through a downflow reflux condenser and, once through, is removed without subsequently passing through the condenser. The liquid flows by gravity without need for liquid head pressure. Moreover, the liquid is rectified as it passes downwardly through the downflow reflux condenser by the countercurrent direct contact flow of vapor generated by heat exchange of the downflowing liquid with higher pressure column shelf vapor. The combination of the elimination of the need for liquid head pressure at the condenser coupled with the rectification of the downwardly flowing liquid within the downflow reflux condenser serves to reduce the temperature of the shelf vapor required to effectively vaporize the bottom liquid. The temperature reduction translates into a pressure reduction thus enabling the higher pressure column to operate at a lower pressure than would otherwise be required for comparable performance. The lower operating pressure reduces the feed compression requirements thus reducing the operating costs for the system.

The invention will be described in greater detail with reference to the cryogenic rectification system illustrated schematically in FIG. 1 wherein feed air undergoes cryogenic rectification for the production of medium purity oxygen. Medium purity oxygen has an oxygen concentration within the range of from 70 to 98 mole percent and is widely used such as by the glassmaking, papermaking, waste incineration and steelmaking industries. Cycles for the production of medium purity oxygen are particularly well suited for incorporation of the practice of this invention because the rectification effect occurring within the downflow reflux condenser is maximized allowing the high pressure column to be operated at a lower pressure than would otherwise be possible.

Figure 1:
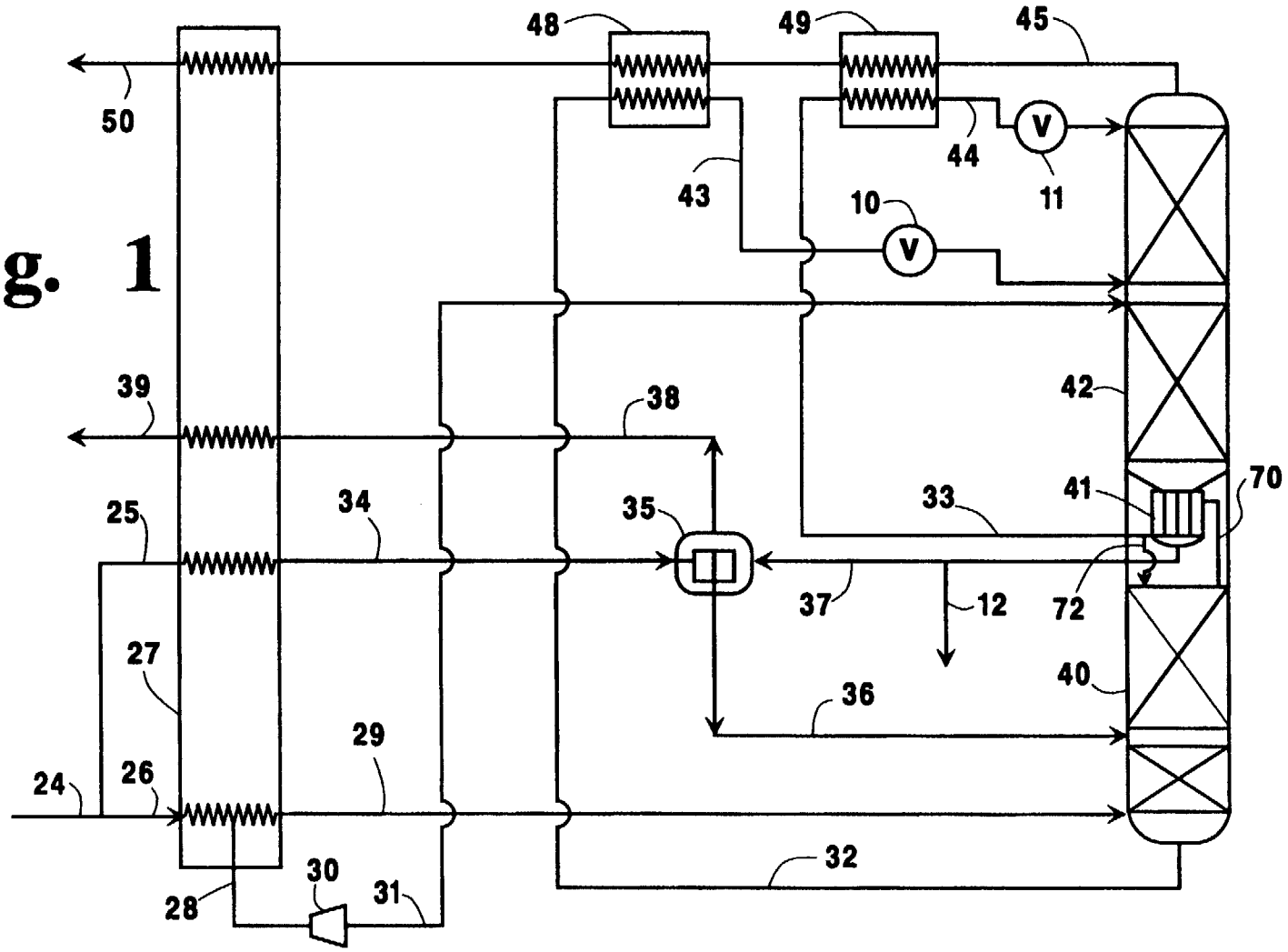
FIG. 1 is a simplified schematic representation of one preferred double column cryogenic rectification system wherein the process and apparatus of this invention may be employed.

Referring now to FIG. 1, feed air 24 which has been substantially cleaned of high boiling impurities such as water vapor and carbon dioxide, and which has been compressed to a pressure generally within the range of from 40 to 80 pounds per square inch absolute (psia), is divided into two streams 25 and 26. Both of these streams enter the warm end of primary heat exchanger 27 wherein they are cooled by indirect heat exchange with return streams. Stream 26 is divided at an intermediate point within primary heat exchanger 27 into main stream 29 and auxiliary stream 28. Main stream 29 completes the traverse of primary heat exchanger 27 and is passed into first column 40 which is the higher pressure column of a double column. Column 40 is operating at a pressure generally within the range of from 35 to 75 psia. Auxiliary stream 28 is removed from primary heat exchanger 27 after partial traverse and is turboexpanded by passage through turboexpander 30 to generate refrigeration. Resulting expanded stream 31 is passed into second column 42 which is the lower pressure column of the aforesaid double column. Column 42 is operating at a pressure less than that of column 40 and generally within the range of from 15 to 25 psia.

Stream 25 is cooled by passage through primary heat exchanger 27 and resulting stream 34 is passed into product boiler 35 wherein it is at least partially condensed by indirect heat exchange with oxygen-richer liquid as will be further described later. Resulting stream 36 is passed into column 40 generally above the point where stream 29 is passed into column 40.

Within column 40 the feed air is separated by cryogenic rectification into oxygen-enriched liquid and nitrogen-enriched vapor. Oxygen-enriched liquid is withdrawn from the lower portion of column 40 and passed in line 32 through heat exchanger 48 wherein it is subcooled by indirect heat exchange with a return stream. Resulting stream 43 is expanded through valve 10 and passed into column 42. Nitrogen-enriched vapor or shelf vapor is passed from column 40 in line 70 into downflow reflux condenser 41. Generally, downflow reflux condenser 41 will be within lower pressure column 42. Within downflow reflux condenser 41, the shelf vapor is condensed by indirect heat exchange with vaporizing oxygen-rich liquid as will be more fully described later. Resulting nitrogen-enriched liquid is passed out of downflow reflux condenser 41. A portion 72 of the nitrogen-enriched liquid is returned to column 40 as reflux. Another portion 33 of the nitrogen-enriched liquid is passed through heat exchanger 49 wherein it is subcooled by indirect heat exchange with a return stream. Resulting stream 44 is expanded through valve 11 and passed into column 42 as reflux.

Within column 42 the various fluid inputs into the column are separated by cryogenic rectification into nitrogen-rich vapor and oxygen-rich liquid. Nitrogen-rich vapor, having a nitrogen concentration of at least 90 mole percent, is withdrawn from the upper portion of column 42 in line 45 and warmed by passage through heat exchangers 49, 48 and 27. Resulting stream 50 is removed from the system and, if desired, may be recovered as product nitrogen.

Figure 2:
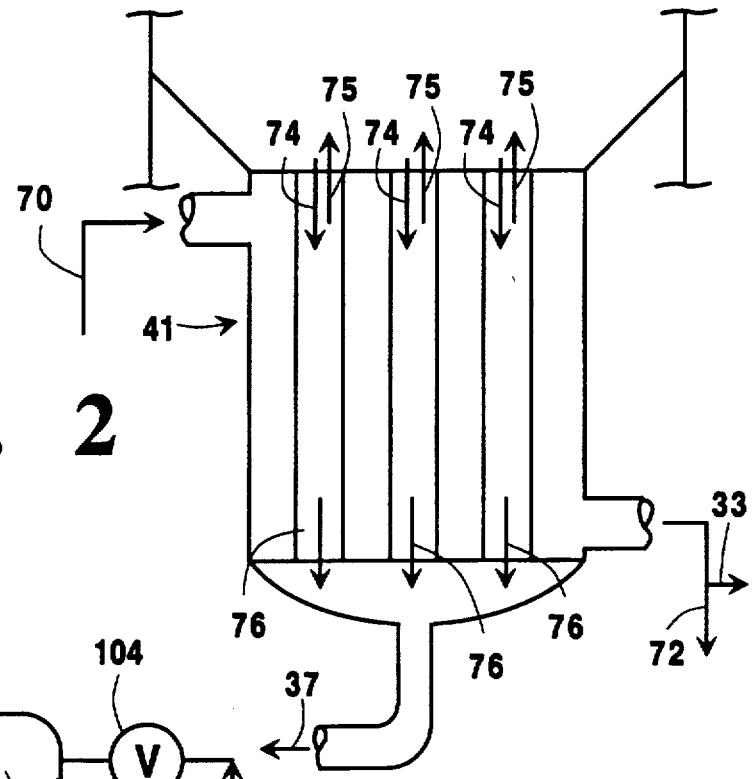
FIG. 2 is a representation of one embodiment of a downflow reflux condenser useful in the practice of this invention.

The oxygen-rich liquid has an oxygen concentration of at least 50 mole percent and generally within the range of from 80 to 95 percent. The oxygen-rich liquid is passed into the upper portion of downflow reflux condenser 41 as shown by flow lines 74 in FIG. 2 which is an enlarged view of one embodiment of the downflow reflux condenser. The numerals in FIG. 2 correspond to those of FIG. 1 for the common elements. As oxygen-rich liquid flows down downflow reflux condenser 41, it is partially vaporized by indirect heat exchange with the aforesaid condensing nitrogen-enriched vapor to produce oxygen-rich vapor. Generally, from about 70 to 85 percent of the downflowing oxygen-rich liquid is vaporized within the downflow reflux condenser. The resulting oxygen-rich vapor flows upwardly through downflow reflux condenser 41 in countercurrent direct contact flow with the downflowing oxygen-rich liquid. The countercurrent direct contact flow of the oxygen-rich liquid and the oxygen-rich vapor within the downflow reflux condenser causes rectification to occur wherein more volatile component, e.g. nitrogen, is passed from the liquid into the vapor and less volatile component, e.g. oxygen, is passed from the vapor into the liquid. The resulting oxygen-rich vapor is passed out from the upper portion of downflow reflux condenser 41, as depicted by arrows 75, having an oxygen concentration which is less than that of the oxygen-rich liquid as it passes into the downflow reflux condenser. This vapor is then passed up column 42 as vapor upflow for the rectification.

The rectification within downflow reflux condenser 41 produces oxygen-richer liquid which has an oxygen concentration which exceeds the oxygen concentration of the oxygen-rich liquid, generally by at least 3 mole percent and typically by at least 5 mole percent. The oxygen-richer liquid passes out of the rectifying section of downflow reflux condenser 41 as depicted by arrows 76 and is withdrawn from the lower portion of downflow reflux condenser 41 in line 37. The oxygen-richer liquid is passed into product boiler 35 wherein it is vaporized by indirect heat exchange with feed air. Product boiler 35 may comprise a downflow reflux condenser or a conventional pool boiling condenser. Resulting oxygen-richer vapor stream 38 is passed from product boiler 35, through primary heat exchanger 27 and recovered as product oxygen stream 39 having an oxygen concentration generally within the range of from 70 to 98 mole percent.

Figure 3:
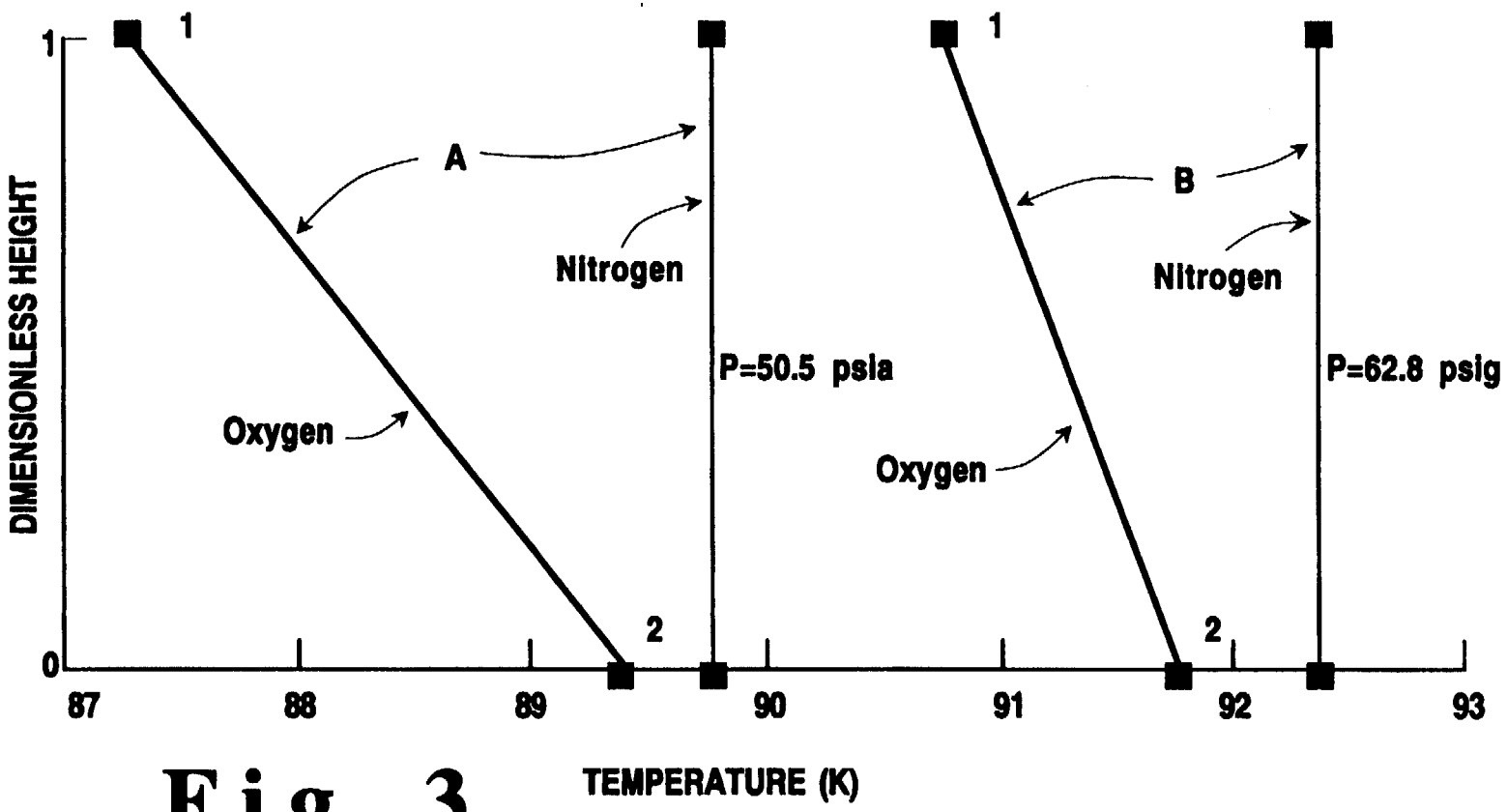
FIG. 3 is a graphical representation of the advantages attainable by the practice of this invention compared with conventional double column cryogenic rectification practice.

FIG. 3 graphically illustrates the advantages attainable with the practice of the invention compared to conventional practice employing a pool boiling condenser. Lines A report the results attained with the practice of the invention while lines B report the results attained with conventional practice.

For comparative purposes, it was considered that both processes would function with a lower pressure column bottom pressure level of 16.5 psia and produce a liquid product of 90 mole percent oxygen. The conventional process involves a liquid head of about 2 psi so that the liquid pressure at the bottom inlet (point 2 of lines B) was 18.5 psia and with 90 mole percent oxygen purity. As the liquid progressed upwards and was partially vaporized, the pressure was reduced to 16.5 psia at the outlet and the purity increased to about 92 mole percent oxygen (point 1 of lines B).

For the process of this invention, the liquid to be vaporized enters at the top of the downflow reflux condenser (point 1 of lines A) and is at the column pressure of 16.5 psia with an oxygen purity of about 80 mole percent. The oxygen-rich liquid exits at the bottom of the downflow reflux condenser at essentially the same pressure of 16.5 psia but at a higher oxygen purity of 90 mole percent (point 2 of lines A).

The difference in the temperatures of A and B at point 1 is related to the different compositions. The invention allows more nitrogen in the oxygen at that point since it will be removed as it progresses through the downflow reflux condenser. The difference in the temperatures of A and B at point 2 is related to the different pressures, since the conventional practice operates at a higher pressure at that point. The corresponding nitrogen temperatures are then chosen to allow equivalent temperature differences for heat transfer for both processes. However, the practice of the invention leads to lower required temperatures and corresponding pressure levels for the high pressure column. As a result the required air feed pressure levels are lower.

A computer simulation of the invention was carried out with reference to the cycle illustrated in FIG. 1. This example is reported for illustrative purposes and is not intended to be limiting. In this example, the pressure at the top of the lower pressure column was 16.2 psia and the higher pressure column was operated at 51.4 psia. The product oxygen had an oxygen concentration of 90 mole percent and was recovered at a pressure of 18.1 psia. Oxygen recovery was 98 percent of the oxygen in the feed air. The operating pressure of the higher pressure column was from about 10 to 11 psia less than that required for comparable results using a conventional system. This resulted in an 8 percent reduction in the feed air compression power requirements.

Figure 4:
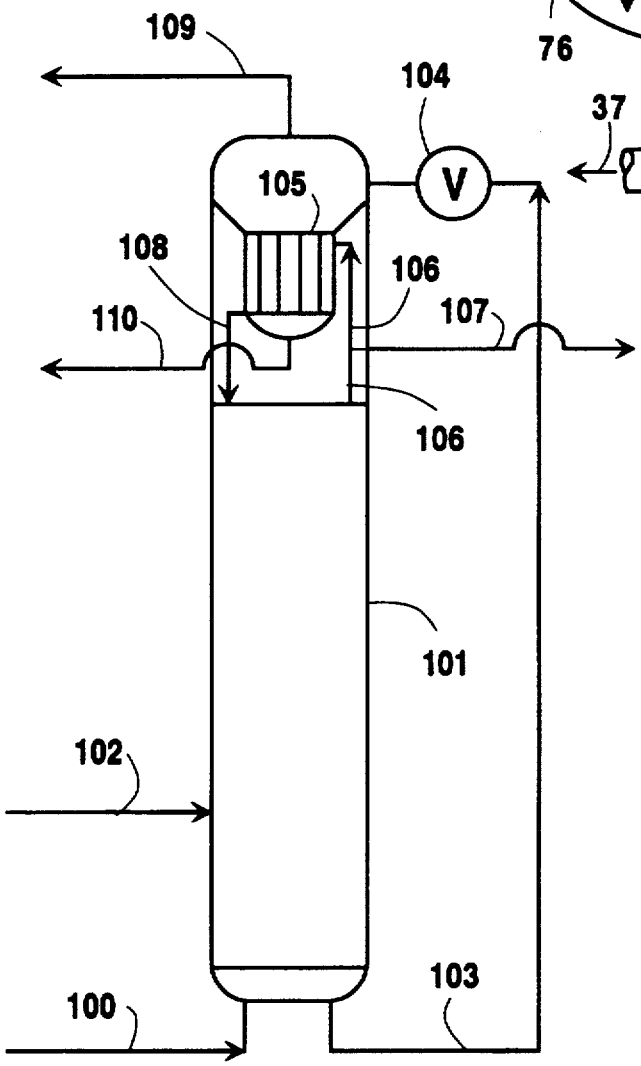
FIG. 4 is a simplified schematic representation of another embodiment of the invention carried out in conjunction with a single column.

The invention may also be practiced in conjunction with a single column cryogenic rectification system. One such system is illustrated in FIG. 4. Referring now to FIG. 4, feed air 100 is passed into single column 101 where it is separated by cryogenic rectification into nitrogen-rich vapor and oxygen-enriched liquid. Column 101 is operating at a pressure generally within the range of from 40 to 250 psia. If desired, a liquid feed air stream 102 may also be passed into column 101. Oxygen-enriched liquid is passed through line 103 and expansion valve 104 into the upper portion of downflow reflux condenser 105. Nitrogen-rich vapor is passed into downflow reflux condenser 105 in line 106. A portion of nitrogen-rich vapor is taken from line 106 in line 107 and recovered as nitrogen product having a nitrogen concentration generally within the range of from 99 to 100 mole percent.

Within downflow reflux condenser 105 a portion of the downflowing oxygen-enriched liquid is vaporized by indirect heat exchange with nitrogen-rich vapor producing oxygen-enriched vapor and nitrogen-rich liquid. The nitrogen-rich liquid is used as reflux for column 101 as illustrated by passage through line 108.

Generally, from about 70 to 85 percent of the downflowing oxygen-enriched liquid is vaporized within the downflow reflux condenser. The resulting oxygen-enriched vapor flows upwardly through downflow reflux condenser 105 in countercurrent direct contact flow with the downflowing oxygen-enriched liquid. The countercurrent direct contact flow of the oxygen-enriched liquid and the oxygen-enriched vapor within the downflow reflux condenser causes rectification to occur wherein more volatile component, e.g. nitrogen, is passed from the liquid into the vapor and less volatile component, e.g. oxygen, is passed from the vapor into the liquid. The resulting oxygen-enriched vapor is passed out from the upper portion of downflow reflux condenser 105 having an oxygen concentration which is less than that of the oxygen-enriched liquid as it passes into the downflow reflux condenser. This vapor is then passed out as waste stream 109.

The rectification within downflow reflux condenser 105 produces oxygen-richer liquid which has an oxygen concentration which exceeds the oxygen concentration of the oxygen-enriched liquid, generally by at least 3 mole percent and typically by at least 5 mole percent. The oxygen-richer liquid passes out of the rectifying section of downflow reflux condenser 105 and is withdrawn from the lower portion of downflow reflux condenser 105 in line 110 and recovered as product oxygen having an oxygen concentration within the range of from 40 to 75 mole percent. If desired, the oxygen richer liquid may be vaporized prior to being recovered.

Although the invention has been discussed in detail with reference to certain preferred embodiments, those skilled in the art will recognize that there are other embodiments of the invention within the spirit and the scope of the claims. Although the invention is particularly well suited for the production of medium purity oxygen, it may be used to produce oxygen of any desired purity. Moreover, the invention may be practiced at higher operating pressures than those recited in the detailed description, and also may be used in a cycle having an argon sidearm column with the double column. The oxygen-richer liquid may be increased in pressure prior to vaporization in the product boiler; some oxygen-richer liquid may be recovered directly as liquid as shown by line 12 in FIG. 1. Also nitrogen liquid may be recovered by extending a line from line 44 of FIG. 1. Refrigeration for the system may be generated by the turboexpansion of a product or other return stream in addition to or in place of the turboexpansion of feed air. Higher purity nitrogen may be produced by adding another section or tophat to the lower pressure column.

We claim:

1. A process for the cryogenic rectification of feed air comprising:

(A) providing feed air into the higher pressure column of a double column and separating the feed air by cryogenic rectification within the higher pressure column into nitrogen-enriched vapor and oxygen-enriched liquid;

(B) passing oxygen-enriched liquid into the lower pressure column of the double column and producing by cryogenic rectification oxygen-rich liquid within the lower pressure column;

(C) passing oxygen-rich liquid into the upper portion of a downflow reflux condenser and vaporizing a portion of the liquid flowing down the downflow reflux condenser by indirect heat exchange with nitrogen-enriched vapor to produce oxygen-rich vapor;

(D) passing oxygen-rich vapor in countercurrent direct contact flow with downflowing oxygen-rich liquid within the downflow reflux condenser to produce oxygen-richer liquid; and (E) withdrawing oxygen-richer liquid from the lower portion of the downflow reflux condenser having an oxygen concentration which exceeds that of the oxygen-rich liquid passed into the upper portion of the downflow reflux condenser.

2. The method of claim 1 wherein the oxygen-richer liquid has an oxygen concentration within the range of from 70 to 98 mole percent.

3. The method of claim 1 wherein the oxygen-richer liquid withdrawn from the lower portion of the downflow reflux condenser has an oxygen concentration which exceeds the oxygen concentration of the oxygen-rich liquid passed into the upper portion of the downflow reflux condenser by at least 3 mole percent.

4. The method of claim 1 further comprising vaporizing withdrawn oxygen-richer liquid and recovering the resulting vapor as oxygen product.

5. The method of claim 1 further comprising withdrawing nitrogen-containing fluid from the lower pressure column and recovering said fluid as product nitrogen.

6. The method of claim 1 wherein withdrawn oxygen-richer liquid is recovered as oxygen product.

7. A cryogenic rectification apparatus comprising:

(A) a double column comprising a first column and a second column;

(B) means for passing feed into the first column and means for passing fluid from the first column into the second column;

(C) a downflow reflux condenser and means for passing fluid from the first column into the downflow reflux condenser;

(D) means for passing liquid into the upper portion of the downflow reflux condenser and means for passing liquid and vapor in countercurrent direct contact flow within the downflow reflux condenser; and (E) means for withdrawing liquid from the lower portion of the downflow reflux condenser.

8. The apparatus of claim 7 further comprising means for recovering fluid withdrawn from the lower portion of the downflow reflux condenser.

9. The apparatus of claim 8 wherein said recovery means includes a product boiler and means for passing liquid withdrawn from the lower portion of the downflow reflux condenser to the product boiler.

10. A process for the cryogenic rectification of feed air comprising:

(A) passing feed air into a single column and separating the feed air by cryogenic rectification within the single column into nitrogen-rich vapor and oxygen-enriched liquid;

(B) passing oxygen-enriched liquid into the upper portion of a downflow reflux condenser and vaporizing a portion of the liquid flowing down the downflow reflux condenser by indirect heat exchange with nitrogen-rich vapor to produce oxygen-enriched vapor;

(C) passing said oxygen-enriched vapor in countercurrent direct contact flow with downflowing oxygen-enriched liquid within the downflow reflux condenser to produce oxygen-richer liquid; and (D) withdrawing oxygen-richer liquid from the lower portion of the downflow reflux condenser having an oxygen concentration which exceeds that of the oxygen-enriched liquid passed into the upper portion of the downflow reflux condenser.

11. The process of claim 10 further comprising recovering nitrogen-rich vapor as nitrogen product having a nitrogen concentration within the range of from 99 to 100 mole percent.

12. The process of claim 10 further comprising recovering oxygen-richer liquid as oxygen product having an oxygen concentration within the range of from 40 to 75 mole percent.

13. A cryogenic rectification apparatus comprising:

(A) a single column and means for passing feed into the column;

(B) a downflow reflux condenser and means for passing fluid from the column into the downflow reflux condenser;

(C) means for passing liquid into the upper portion of the downflow reflux condenser and means for passing liquid and vapor in countercurrent direct flow contact within the downflow reflux condenser; and (D) means for withdrawing liquid from the lower portion of the downflow reflux condenser.

* * * * *